US005172642A

United States Patent [19]

Iannuzzelli et al.

[11] Patent Number: 5,172,642

[45] Date of Patent: Dec. 22, 1992

[54] STUDIO STORAGE TABLE

[76] Inventors: Catherine J. Iannuzzelli; Nicholas J. Iannuzzelli, Jr., both of 271 Mallory Ave., Staten Island, N.Y. 10305

[21] Appl. No.: 775,591

[22] Filed: Oct. 15, 1991

[51] Int. Cl.[5] ..... A47B 5/00

[52] U.S. Cl. ..... 108/25; 297/193

[58] Field of Search ..... 108/25, 24, 53.1, 53.3, 108/53.5; 297/193

[56] References Cited

U.S. PATENT DOCUMENTS

| | | | |
|---|---|---|---|
| 743,772 | 11/1903 | Thomas | 108/25 X |
| 2,603,028 | 7/1952 | Roberts | 297/193 X |
| 2,725,923 | 12/1955 | Bachrach | 297/193 |
| 2,871,536 | 2/1959 | Childress | 108/53.3 X |
| 2,919,169 | 12/1959 | Jackson | 297/193 X |
| 4,361,356 | 11/1982 | Tunick | 297/193 X |

FOREIGN PATENT DOCUMENTS

| | | | |
|---|---|---|---|
| 47821 | 9/1933 | Denmark | 108/25 |
| 864013 | 4/1941 | France | 297/193 |
| 602055 | 7/1978 | Switzerland | 297/193 |

*Primary Examiner*—Jose V. Chen

*Attorney, Agent, or Firm*—Richard C. Litman

[57] ABSTRACT

A table is provided which can act as a storage device. A cylindrical table is provided with a removable table top for storage. Wheels inserted into a reinforced bottom facilitate portability. A tapered sidewall with a plurality of groove strips near the bottom allow for easy stacking and unstacking. Air holes are provided offside the reinforced strips of the bottom to allow air to enter the storage area. The tables may be stored in a nested configuration.

6 Claims, 1 Drawing Sheet

STUDIO STORAGE TABLE

FIELD OF THE INVENTION

The present invention relates to a combination table and storage device. More particularly this invention relates to a table with a removable top to permit access to an interior storage area.

DESCRIPTION OF THE PRIOR ART

Tables which have a storage space incorporated within their basic structure are known in art. U.S. Pat. No. 743,772 issued to Thomas discloses a kitchen table. This device has a plurality of compartments incorporated on the top of the table and on the side of the table which are designed to accommodate various articles used in cooking.

U.S. Pat. No. 2,595,144 issued to Isaacson discloses a hassock of the type having a hollow interior. The principal object of this device is to retain several pairs of shoes during their non-use.

U.S. Pat. No. 2,608,241 issued to Doern discloses a combination hassock and storage box. This device has a removable lid and includes a partition assembly designed to separate the interior of the storage box into compartments.

U.S. Pat. No. 2,919,169 issued to Jackson discloses a multipurpose container with a seat forming cover. This device consists of a handle equipped bucket with internal compartments designed to store picnicking, camping and/or fishing devices. The cover is detachable and cushioned.

None of the above referenced devices, considered either singly or in combination, is seen to suggest the instant invention as claimed.

SUMMARY OF THE INVENTION

With lack of storage space a major concern in modern times, storage devices which can be employed in a utilitarian fashion are desirable. The instant invention is a practical table, which has inherent in its structure a storage area. This storage area is accessible through a removable table top. Through the use of mounted wheels the table can readily be moved even when heavily loaded. The tables when empty have the capacity to be nested within each other. The wheels are also removable which can allow the table to become stationary.

Accordingly, one object of the present invention is to provide a table with a significant storage capacity. Another object of the present invention is to provide a table which can be easily moved.

Another object of the present invention is to make a table which can be stacked and or nested for maximum space efficiency.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
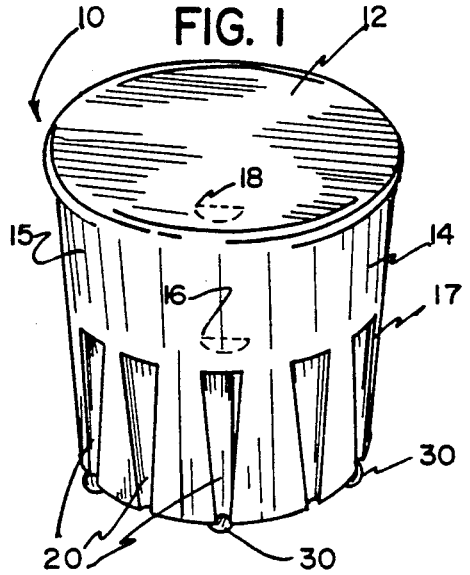
FIG. 1 is a top perspective view of the Storage Table.
Figure 2:
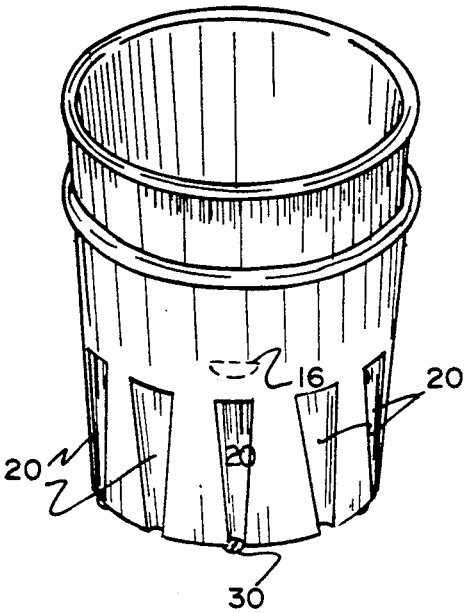
FIG. 2 is a perspective view of two Storage Tables in nested relation.
Figure 3:
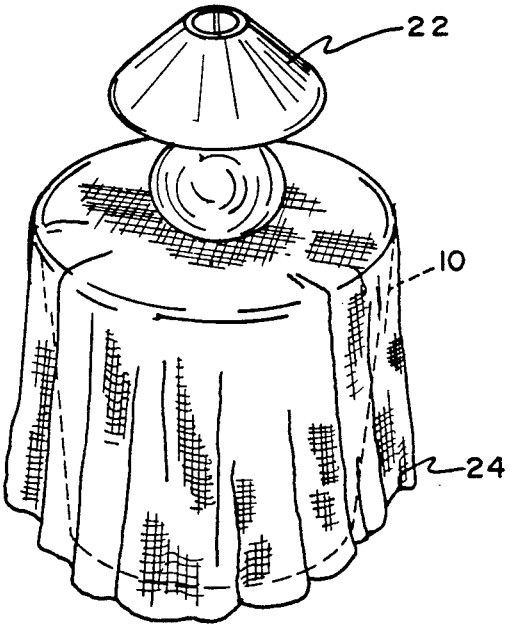
FIG. 3 is a perspective view of the Storage Table.
Figure 4:
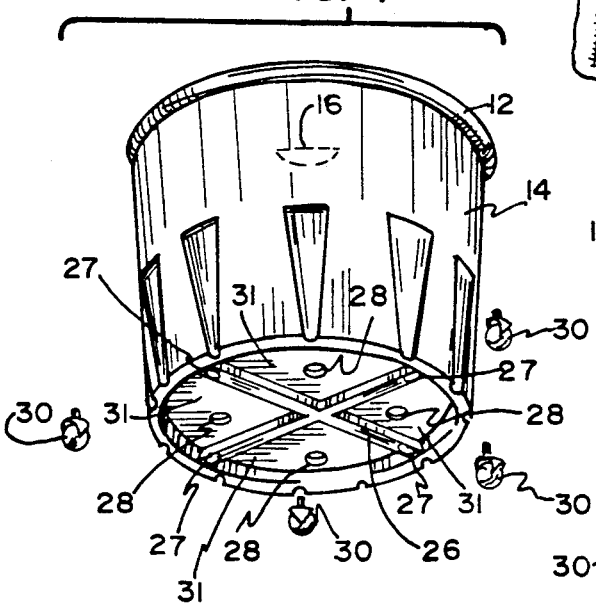
FIG. 4 is a bottom perspective view of the Storage Table.
Figure 5:
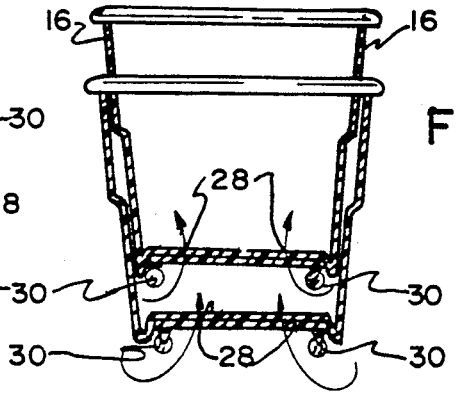
FIG. 5 is a cut away view showing two Storage Tables in nesting relation.

The present invention consists of a cylindrical storage table 10 with a removable table top 12. Table top 12 fits in a conventional snap lock relationship to the cylindrical portion of the table 10. The table top 12 itself acts as the table face, whereas the cylindrical structure acts as the table support. The cylinder is hollow and has a bottom panel (31 FIG. 4) attached to the circular sidewall 15 in a unified one piece construction. The bottom panel 31 is reinforced by two strips 36 which form a cross or X-style pattern on the surface. This thicker layer gives stability as well as support to the table 10. The reinforced layers include insert holes 27 for wheels 30, which are placed on the outer ends of the reinforcement near the sidewall 15 for maximum table stability. Air holes 28 are provided on the bottom panel 31 as well, in the areas bounded by the reinforcement strips 26. This permits aeration of the stored contents. A plurality of perforations (16, 18) are made on the upper portion 14 of sidewall 15 and on the table top 12. These perforated areas (16, 18) are designed to be removed if so desired to form hand holds. On the lower end 17 of the outer sidewall 15 grooves 20 are cut into the surface. These grooves 20 are in an elongated v-shape and allow the storage table 10 to be pulled apart if in a nested relation (FIG. 5). The storage table 10 may be provided with a table cloth 24 or other suitable additions. The storage table 10 is completely functional, for example it is shown with a lamp 22 in FIG. 3.

Many different sizes of the storage table may be provided. A preferred example; for instance, may have the following dimensions. A height of 25 inches, a top circumference of 64.5 inches, a midsectional circumference of 63.5 inches and a bottom circumference of 61.5 inches.

An array of colors and patterns should be afforded to enhance the storage table's appearance if the use of a table cloth 24 or cover is not desired. The storage table 10 may be constructed of heavy duty plastic material; however, the storage table 10 may be constructed of any suitable material.

It is to be understood that the present invention is not limited to the sole embodiment described above, but encompasses any and all embodiments within the scope of the following claims.

We claim:

1. A generally cylindrical storage table which may be stacked in nested fashion with other similar tables when empty, said storage table comprising:

a storage area, said storage area bounded by a tapered cylindrical sidewall, a top member and a bottom member;

said sidewall having an upper region and a lower region;

said bottom member permanently affixed to said lower region of said sidewall;

said top member removably attached to said upper region of said sidewall and serving both as a horizontal planar surface forming a top for said table and a lid for said storage area;

said lower region having means for enabling easy separation of said storage table from other similar storage tables when stacked in said nested fashion, including a plurality of elongated V-shaped indented grooves disposed circumferentially on said sidewall and extending internally into said storage area to thereby limit insertion of said storage table into said other similar storage tables when stacked in said nested fashion;

said bottom member having a plurality of radially crossed reinforcing strips thereon;

whereby said top member can be removed from said sidewall permitting access to said storage area.

2. A storage table as claimed in claim 1 wherein said top member further includes perforations, whereby a handle hold may be punched out.

3. A storage table as claimed in claim 1 wherein said sidewall further includes perforations, whereby a handle hold may be punched out.

4. A storage table as claimed in claim 1 wherein said reinforcing strips include means to attach rollers.

5. A storage table as claimed in claim 4 wherein rollers are attached to said reinforcing strips proximal said lower portion of said sidewall.

6. A storage table as claimed in claim 1 wherein said top member is of a generally circular configuration.

* * * * *